US010807684B2

(12) United States Patent
Murray et al.

(10) Patent No.: US 10,807,684 B2
(45) Date of Patent: Oct. 20, 2020

(54) RETRIEVABLE TOW-ROPE HARNESS

(71) Applicants: Shaun Murray, Orlando, FL (US); Daniel Harf, Orlando, FL (US)

(72) Inventors: Shaun Murray, Orlando, FL (US); Daniel Harf, Orlando, FL (US)

(73) Assignee: SURF REEL SYSTEMS, LLC, Orlando, FL (US)

( * ) Notice: Subject to any disclaimer, the term of this patent is extended or adjusted under 35 U.S.C. 154(b) by 0 days.

(21) Appl. No.: 16/254,981

(22) Filed: Jan. 23, 2019

(65) Prior Publication Data

US 2019/0276120 A1 Sep. 12, 2019

Related U.S. Application Data

(60) Provisional application No. 62/640,950, filed on Mar. 9, 2018.

(51) Int. Cl.
*B63B 34/67* (2020.01)
*B63B 21/56* (2006.01)

(52) U.S. Cl.
CPC ..... *B63B 34/67* (2020.02); *B63B 21/56* (2013.01)

(58) Field of Classification Search
CPC . B63B 21/56; B63B 2021/566; B63B 35/815; B63B 35/816; B63B 34/60; B63B 34/67
USPC ..... 114/253, 254
See application file for complete search history.

(56) References Cited

U.S. PATENT DOCUMENTS

| | | | | |
|---|---|---|---|---|
| 2,998,796 | A | 9/1961 | Wittrock | |
| 3,547,371 | A | 12/1970 | Gruseck | |
| 3,643,886 | A | 2/1972 | Colton | |
| 3,919,963 | A | 11/1975 | Cox, III | |
| 4,969,610 | A | 11/1990 | Taylor et al. | |
| D506,124 | S | 6/2005 | Strickland et al. | |
| 7,334,808 | B2 * | 2/2008 | Fatzinger | B63B 35/816 114/253 |
| 8,220,405 | B2 | 7/2012 | Christensen et al. | |
| 8,689,719 | B1 | 4/2014 | Roberts | |
| 9,592,890 | B2 | 3/2017 | Christensen et al. | |
| 2003/0084833 | A1 | 5/2003 | Sheikholeslam et al. | |
| 2006/0027155 | A1 | 2/2006 | Welch | |
| 2008/0054118 | A1 | 3/2008 | Czajkowski | |
| 2011/0143846 | A1 | 6/2011 | Davis | |

* cited by examiner

*Primary Examiner* — Ajay Vasudeva
(74) *Attorney, Agent, or Firm* — Timothy H. Van Dyke; Wolter, Van Dyke, Davis, PLLC

(57) ABSTRACT

Disclosed herein are embodiments for improving the safety of tow-based watersports. Specifically exemplified embodiments disclosed herein include systems and methods for retrieving a tow rope that facilitates the provision of a tow rope to a wake surfer, dispensing of the tow rope while wake surfing and presenting a rope to a downed wake surfer at a safe and ideal position relative to boat.

4 Claims, 10 Drawing Sheets

45° SPRING SWIVEL ARM

TENSION

NO TENSION

RETRIEVABLE TOW-ROPE HARNESS

BACKGROUND

Wakesurfing is an exciting new watersport that involves riding the wake of a boat similar to how a surfer rides a wave on the ocean. Wakesurfing typically requires the use of a heavy and powerful inboard boat that is capable of producing a large wake. Given the nature of wake formation behind such boats, a wakesurfer must ride the wake at a location that is only a few feet from the stern of the boat, referred to herein as the wake surfzone.

The primary technique that wakesurfers use to enter the wake surfzone is similar to conventional wake boarding or most towed watersports when doing a "deep water start." The wakesurfer starts in the water behind the boat as they hold onto a fixed length of tow rope. As the boat proceeds, and the wake surfer rises onto a stable plane, they may pull into themselves a portion of the rope to situate themselves in the wake surfzone. Sometimes the wake surfer is already in the wake surfzone. Either way, once in the wake surfzone, the wake surfer goes from being pulled by the rope to being pushed by the wave, and must dispose of the tow rope so that the wake surfer is only being propelled by the continuous wake and not by a tow rope.

Most commonly, wake surfers throw the rope into the back of boat. However, as disclosed herein, this comes with certain significant risks.

SUMMARY

The inventors have identified significant risks associated with the common techniques of disposing of a tow rope once a wake surfer has entered a wake surfzone, and have devised a system to minimize such risks.

When the surfer goes from being pulled to pushed, they tend to try and manage the extra rope by grabbing the extra rope in a disorganized coiling manner. These sloppy coils can wrap around hands and wrists and if they go from being pushed to pulled, those coils can manage to tighten on body parts causing serious injury or dismemberment. Embodiments described herein can automatically retrieve slack in the tow rope thereby diminishing the need to coil the rope around the wake surfer's limbs.

It was already mentioned above that the wake surfer typically needs to dispose of the rope as the "push" from the wake begins. Most commonly, the wake surfer throws the rope and handle into the back of the boat. The handles used in most tow ropes are made of hard and heavy plastics and/or metals. Throwing the handle of the rope can lead to injury to any passengers observing in the back of the boat.

Moreover, the rope can get wrapped around the arms, limbs or fingers of passengers in the boat. If there is any portion of the rope that is not fully within the boat, the drag of the water can catch the rope causing it to forcefully jerk, or if still being held by the wake surfer who falls or loses the push thereby creating a sudden force on the rope being held by the passenger, all of which can lead to serious injuries or even possible dismemberment of the passenger.

If the passengers manage to avoid serious injury, the wake surfer behind the boat may also be in peril from the rope or handle that violently jerks around behind the boat as it catches water, and can cinch itself around a body part. In addition, the rope and handle can damage personal property associated with the boat, passengers or wake surfer.

In addition to addressing the above risks associated with conventional tow ropes used by wake surfers, embodiments described herein provide an added benefit of providing a more facile way of providing a rope to a downed wake surfer. The embodiments described herein provide a way of keeping the tow rope accessible to a downed wake surfer, while at the same time avoiding the above-noted risks.

According to a first embodiment, disclosed is a tow-rope harness that comprises a spring-driven or motor-driven retrieving reel engaged to a frame designed for attachment to a tow-rack. The frame of the harness has a top end, bottom end and two opposing sides. Associated with the top end of the frame is an attachment clamp for securing the frame to a tow-rack. In one example, the retrieving reel is secured to frame and at least partially enclosed by the top end, bottom end and the two opposing sides. The retrieving reel includes a spindle around which at least a portion a tow-rope is wrapped. The bottom side of the frame includes an aperture through which the tow rope passes. On the outerside of the aperture, the tow rope includes a stopcatch member situated at a point to stop the retrieving reel from any further retrieval of the tow rope.

Tow-racks are commercially available in a host of configurations but typically are comprised of one or more cylindrical tubing members that are secured at 2, 3, 4 or more locations on the boat. Most tow racks (also known in the field as a wakeboard tower) are at least secured to both the starboard and port sides of the boat. A non-limiting list of tow-rack examples includes those disclosed in the following U.S. Pat. Nos. 7,392,758; 6,925,957; 6,374,762; 6,945,188 and 9,221,528.

In a specific embodiment, the attachment clamp includes at least two matable members. In one example, the matable members are securable together by one or more screws. Alternatively, other suitable securement mechanism can be used, including but not limited to, clips, tabs, etc. In a specific example, the two matable members may be or have portions thereof that arcuate in shape. The term arcuate as used herein broadly refers to a shape marked by a curve or rounded bend. The term arcuate includes an arch shape, or also a circular shape, oval shape or elliptical shape.

In another example, the attachment clamp may include a single flexible member having opposing ends where the single flexible member is bent into an arcuate shape. The opposing ends each have a flange such that when the ends come together the opposing flanges may be secured together with a securement mechanism, including but not limited to a clip, screws, tabs, etc. The attachment clamp is engaged to a tow rack or other cylindrical portion of a boat by flexing open the clamp such that the opposing ends pass over and around the tow rack.

The attachment clamp provides for easy placement and attachment of the harness at any location on the tow-rack. In one particular example, the harness is attached proximate to (0-3 feet) from where the tow-rack is secured to either the starboard or port side of the boat. It has been found that the ability to secure the harness proximate to the such location provides facile operation of the tow rope, and increases safety to boat passengers, as it avoids the need for throwing the rope into the boat.

The stopcatch member may be fixed onto the tow rope at a location such that when the tow rope is fully retracted, a sufficient amount of rope remains in the water alongside the boat. When a wakesurfer no longer needs the rope, they can simply let go and the rope retracts into the harness such that the rope safely drags alongside the side of the boat. This also provides an advantage during when the boat picks up a downed wakesurfer. The boat can approach the downed wakesurfer in a safe manner whereby as the boat passes the downed wakesurfer, they can grab the tow rope which then will extend out to a fully extended state as the boat prepares for launch of the wakesurfer.

In one example, the length of the rope extending out of the harness when the rope is in the fully retracted state (lag portion of the rope) ranges from 0-12 feet. In a more specific example, the lag portion of the rope is 4-9 feet. In the fully extended state, the rope may be 14-40 feet extended out of the harness. In a more specific example, the rope dimension extending out of the harness in the fully extended state is 14-24 feet. In another example, the distal end of the rope includes a handle associated therewith.

In another embodiment, disclosed is a tow-rack that has at least one tubular member and at least a first and second bracket that are engageable to a starboard and port side of a boat, respectively. The tow-rack includes a tow-rope harness that is attached proximate to one or the other first and second bracket. Alternatively, the tow-rack does not include a first and second bracket but rather a junction points where the tow-rack and boat abut one another on either side of the boat. In this example, the harness is proximate to the junction point. The harness comprises a spring-driven or motor-driven retrieving reel engaged to a frame designed for attachment to a tow-rack. The frame of the harness has a top end, bottom end and two opposing sides. Associated with the top end of the frame is an attachment clamp for securing the frame to a tow-rack. In another embodiment, provided is a boat that includes the tow-rack and harness combination discussed above.

According to another embodiment, disclosed is a method of wakesurfing behind a boat having a tow-rack and harness combination as discussed above. The method involves grabbing the handle of the tow rope by a downed wakesurfer having a wake surfboard as the boat passes by the downed wakesurfer; once the rope is in a fully extended state, launching the wakesurfboard onto a plane as the boat increases in speed; and once in a wake surfzone behind the boat, releasing the handle such that the rope retracts into the harness leaving lag portion of the rope alongside the boat while the wakesurfer wakesurfs in the wake surfzone.

According to another embodiment, provided is a boat that has a retrievable rope system. Based on the teachings provided herein, one skilled in the art would appreciate that a harness could be attached to a boat at a location that would allow the functionality as described above, namely the ability to provide a lag portion alongside the boat such that it is accessible to a downed wake surfer or trailing the boat. This could be on a location on the side or stern of the boat or within the outer hull of boat where there is a portal to allow for the tow rope to pass. In this alternative example, the stop catch member could be located downstream of the portal. The harness could be attached more central to the boat or even or more centrally located on a tow-rack, but where the tow-rack and/or boat comprises a series of pulleys that direct the rope in a safe manner to provide the lag portion alongside the boat.

The terminology used herein is for the purpose of describing particular embodiments only and is not intended to be limiting. As used herein, the singular forms "a," "an," and "the" are intended to include the plural forms as well, unless the context clearly indicates otherwise these terms do not denote a limitation of quantity, but rather denote the presence of at least one of the referenced item. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order, quantity or importance, but rather the terms first, second, etc., are used to distinguish one element from another.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

DETAILED DESCRIPTION OF ILLUSTRATED EMBODIMENTS

Figure 1:
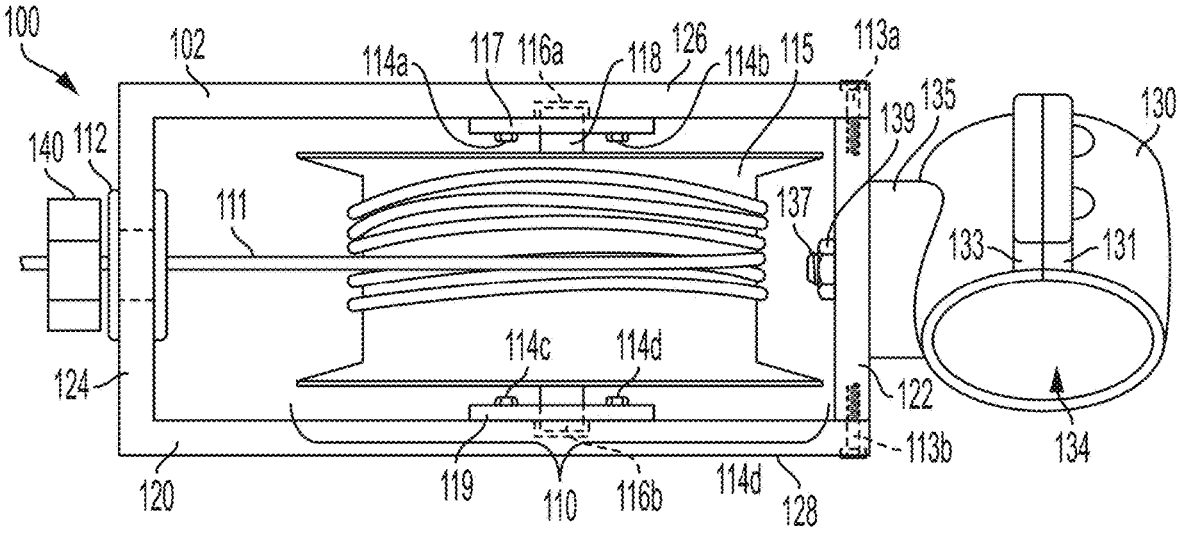
FIG. 1 shows a side view of a tow-rope harness embodiment.
Figure 2:
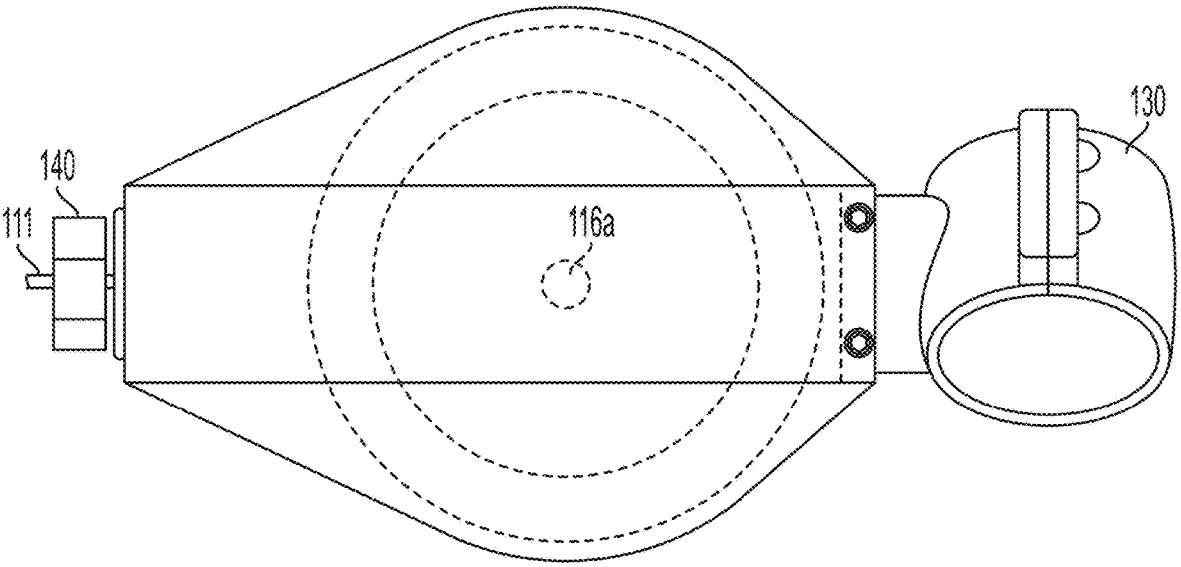
FIG. 2 shows a top view of the tow-rope harness embodiment shown in FIG. 1.

Turning to the drawings, FIG. 1 shows a side view of a harness embodiment 100 and FIG. 2 shows a top view of the harness embodiment, with a part of the harness 100 rotated. The harness 100 includes a frame 102 that has a top end 122, a bottom end 124, a first side 126 and a second side 128. Engaged to the top end 122 is an attachment clamp 130, that has a receptacle 134 for receiving a tow-rack (not shown). The attachment clamp 130 as shown comprises a body of material 132 having two ends where the body is bent in an arcuate shape, e.g. a cylindrical shape. The attachment clamp 130 can be secured so as have a static orientation relative to the frame 102, or alternatively can rotate relative to the frame 102. At the ends of the body 132, the body has two flanges 131, 133 that come together that are held together by screws or similar fastening mechanisms. To assist access to the screw head, the attachment clamp may have recesses defined therein 136 *a,b*. The attachment clamp is rigidly attached to a brace 135 which attaches to the top end 122 of the frame 102 via a screw 137 and nut 139 arrangement.

The harness 100 includes a retrieving reel 110 that is secured to the first and second sides 126, 128 of the frame 102 via a first and second batten members 117, 119 held onto the first and second sides 126, 128, respectively view screws 114*a-d*. The retrieving reel 110 includes a spindle 118 that passes through a spool 115 and rests within receptacles 116*a,b* defined in the first and second sides 126, 128 respectively. Around the spool 115 is wrapped a tow rope 111, which passes through a grommet 112 held in the bottom end 112. The spool is associated with a spring mechanism or motor (not shown) that urges the rotation of the spool such that the tow rope 111 is retracted when no counter force is applied to the tow rope 111. Attached to the tow rope 140 is a stopcatch 140 that prevents retraction of the tow rope 111 behind a predetermined location.

Figure 3:
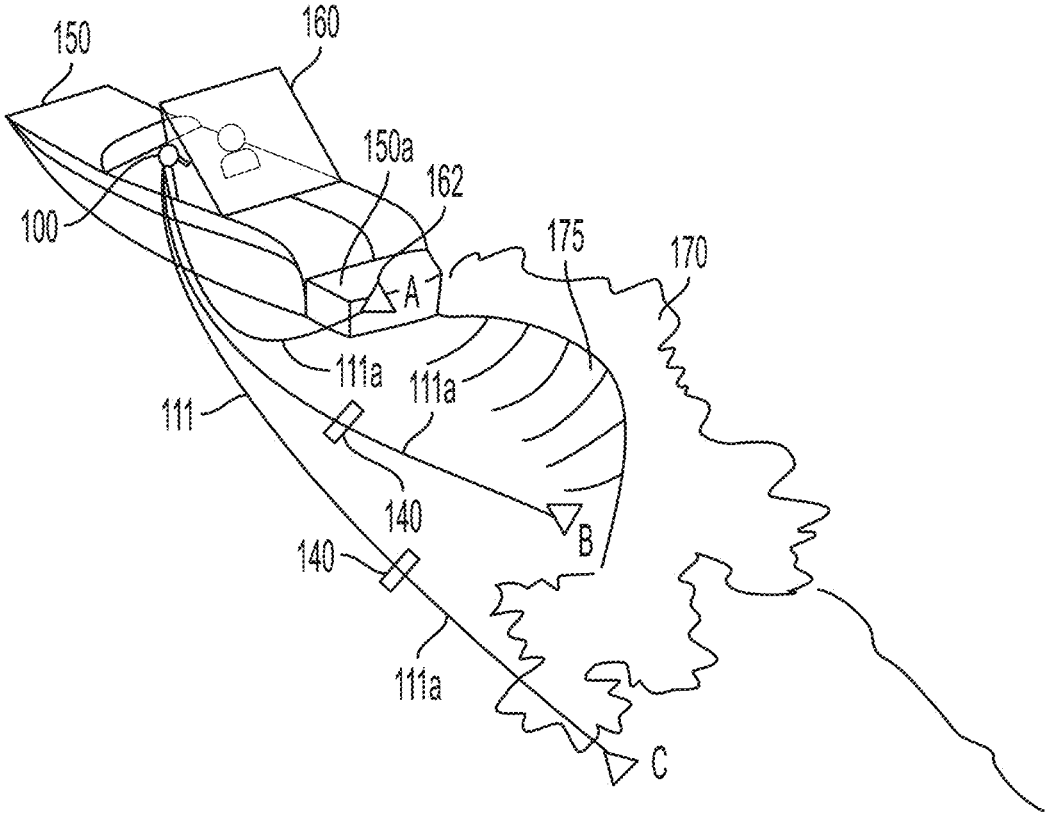
FIG. 3 is a diagram depicting a tow-rope and harness and dimensions and states of the tow-rope.

FIG. 3 shows a few different examples of the dimensions of the tow rope 111. The tow rope 111 has a stopcatch member 140 and as shown in example A, includes a lag portion that extends from the harness 100 as the rope is in a fully retracted state. At the end of the rope is a handle 162. In the fully retracted state A, the rope drags alongside the boat where the handle 162 rides just off the side of the stern 150*a* of the boat 150. The lag portion 111*a* may be 0-12 feet. According to one version (B), the tow rope 111 is in a fully extended state where the rope 111 is extended 14-26 feet from the harness 100. In example C, shown is a version where the tow rope 111 is 14-40 feet when in a fully extended state. In version B, the rope is dimensioned such that the length of the rope allows for the wake surfer to be at about the wake surfzone 175 of the wake 170. Importantly, in any of the versions, the harness 100 is able to be attached on a tow-rack 160 proximate to where the tow-rack 160 meets the side of the boat 150. As noted above, this allows for the proper positioning of the lag portion 111*a* of the tow rope 111 to ride safely along the side of the boat 150.

Figure 4:
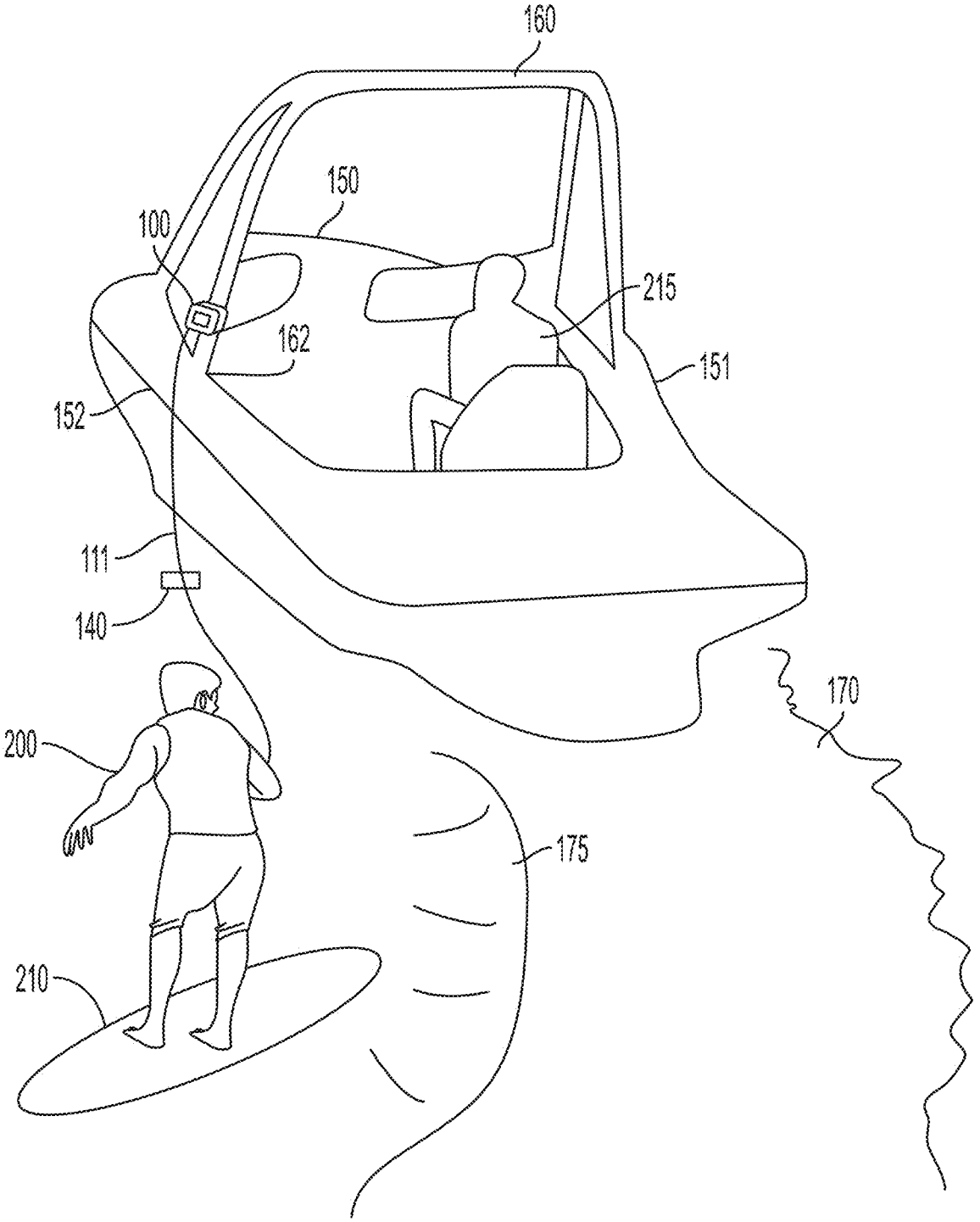
FIG. 4 is diagram depicting a tow-rope and harness embodiment in use.

FIG. 4 shows a version of the harness 100 while in use by a wake surfer 200 riding a wake surfboard 210. The tow rope 111 is in a fully extended state where the stopcatch 140 is at a distance from the harness 100. The wake surfer 200 is positioning themselves at the wake surfzone 175 of the wake 170, where when in the desired position, they can release the handle (not shown) thereby allowing the tow rope 111 to retract back to the harness 100. The boat 150 includes a tow-rack 160 that is mounted to both the starboard 151 and port 152 sides of the boat. In the illustrated example, the harness 100 is mounted proximate to the port side 152 of the boat 150.

Figure 5:
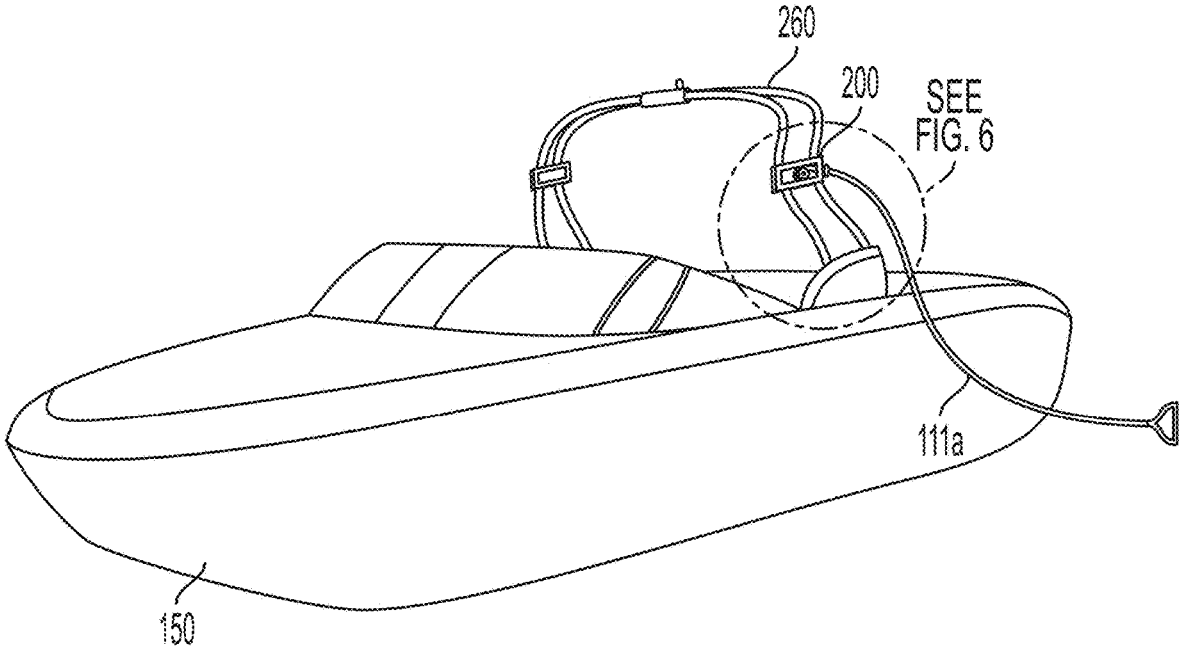
FIG. 5 shows a perspective view of a tow-rack embodiment that includes a retrievable rope system.
Figure 6:
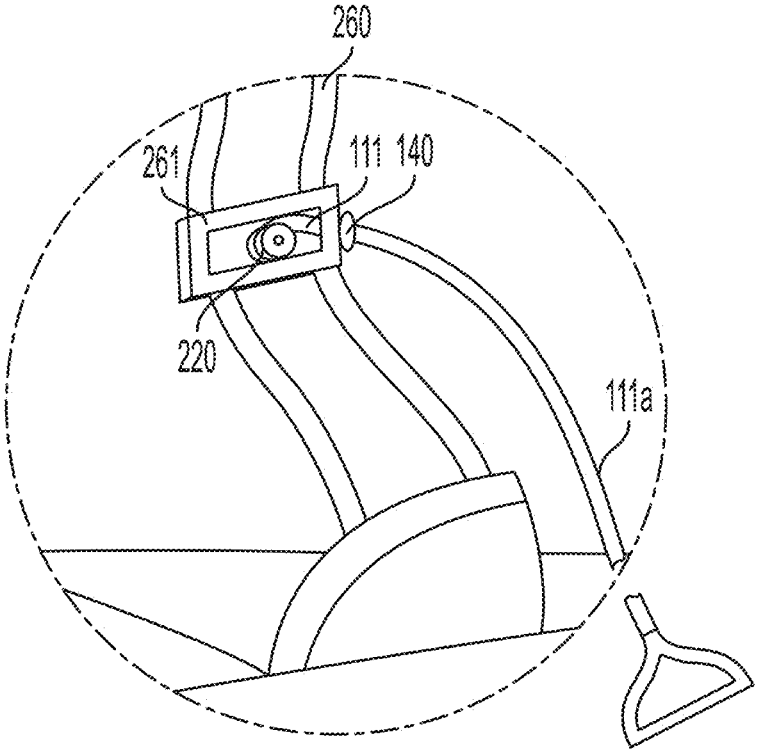
FIG. 6 shows a close-up view of the circled region shown in FIG. 5.

FIGS. 5 and 6 show a tow-rack embodiment 260 that has an outer housing 261 with a retrievable rope system 200 at least partially contained and secured within the outer housing 261 of the tow-rack 260. Shown in FIG. 5 is the lag portion 111*a* of the rope extending from the tow rack 260 and system 200. The retrievable rope system 200 is situated on the tow-rack 260 such that the rope 111 can extend from the system 200 and ride alongside the boat 150. One skilled in the art will appreciate that in view of the teachings herein that the system 200 can be provided at a number of locations on the tow-rack 260. Typically, the system 200 is provided proximate to the junction between the boat 150 and tow-rack 260, but could be placed away from this location whereby the rope 111 passes through channels and/or pulleys (not shown) to direct the rope 111 out and alongside the boat 150. The rope 111 is wrapped around a reel 220 that is motor-driven or spring-driven to spin the reel 220 to retrieve the rope 111 when no counter-force is applied to the rope 111. A stop-catch 140 is provided to keep the lag portion 111*a* of the rope from being pulled into system 200 at an opening provided in the housing 261.

Figure 7:
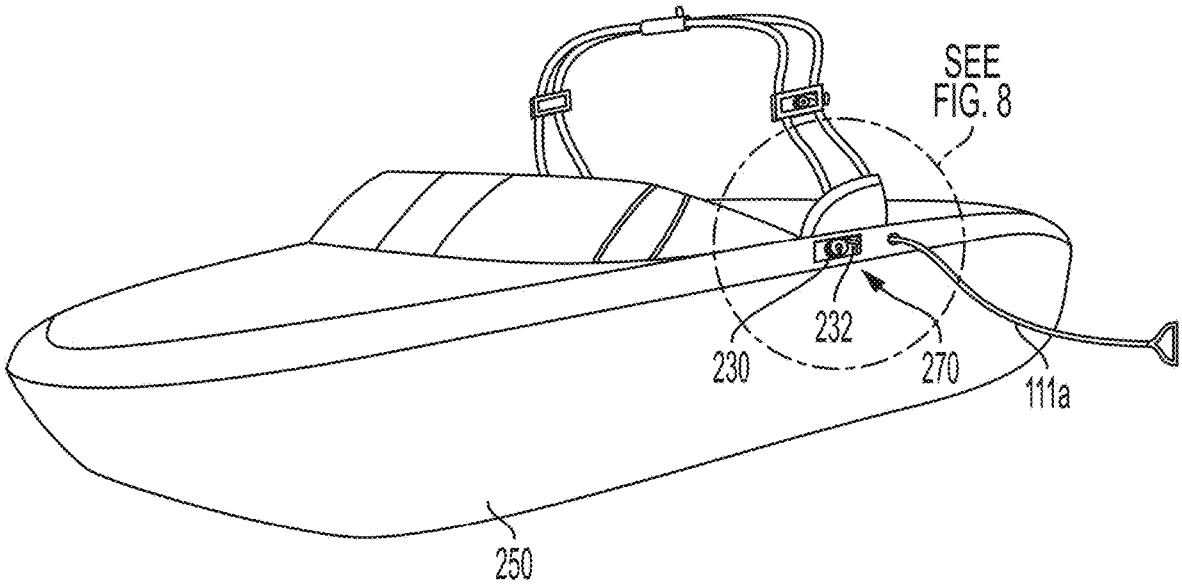
FIG. 7 shows a perspective view of a boat that includes a retrievable rope system incorporated into a side-wall thereof.
Figure 8:
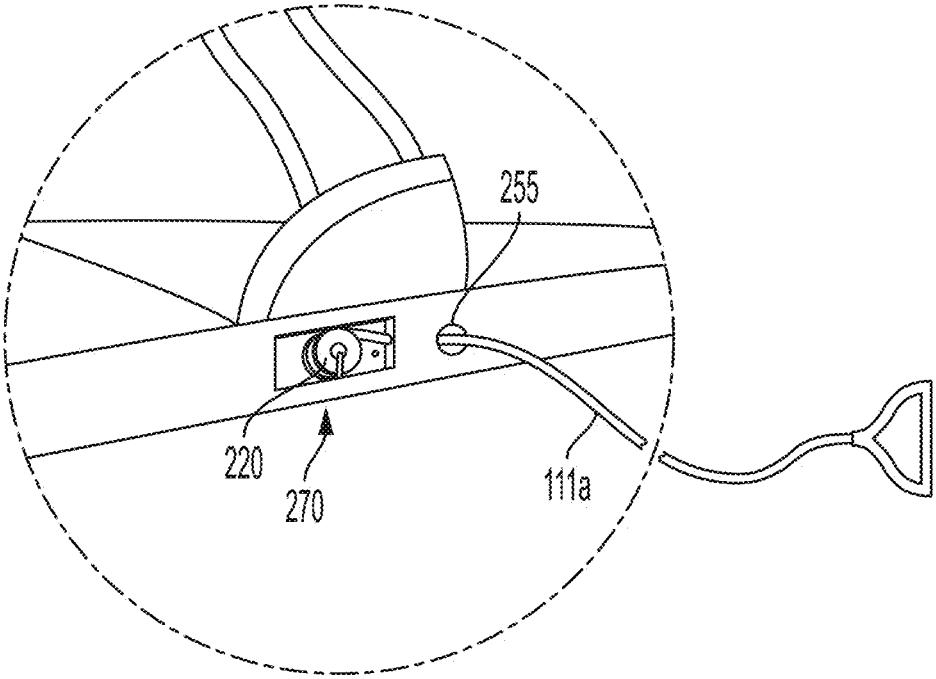
FIG. 8 is a close up of the circled region shown in FIG. 7.

FIGS. 7 and 8 show a boat 250 that has a retrievable rope system 270 integrated attached to the boat structure 250. The system 270, as shown, includes a compartment 230 having a door 232 to access a reel 220 with rope 111 wrapped there-around. The boat 250 has a portal 255 through which the rope 111 passes. Once skilled in the art will appreciate that the system 270 and portal 255 can be positioned at numerous locations about the boat 250. In a typical arrangement, the portal 255 is provided on one or other of the sides of the boat 250 to allow the rope 111 to ride along side of the boat 250 when in a retracted position. The rope may optionally include a stop-catch similar to that described above.

Figure 10:
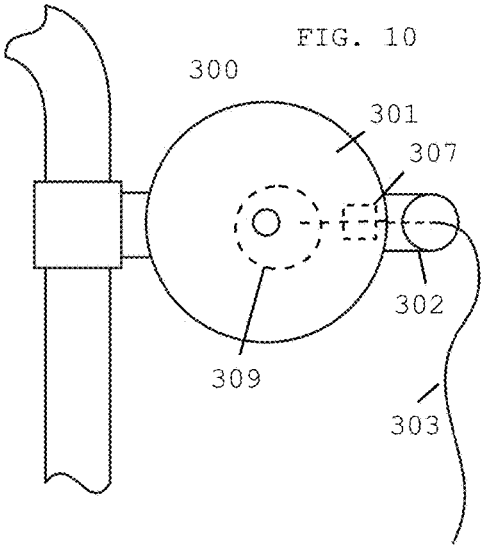
FIG. 10 shows the pivotable and retrievable rope system embodiment shown in FIG. 9 under tension.
Figure 9:
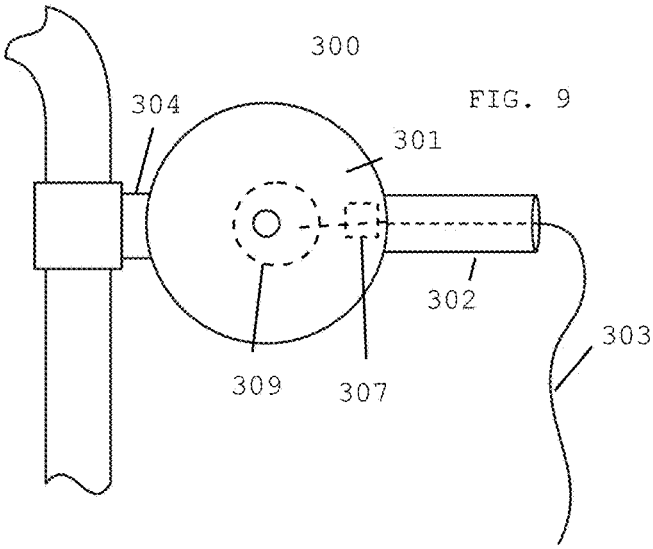
FIG. 9 shows a pivotable and retrievable rope system embodiment not under tension.

FIGS. 9-10 show a further embodiment of a pivotable tow-rope harness 300. As shown in FIGS. 9 and 10, the harness 300 includes a reel housing 301 associated with a pivotable arm 302 that serves as a conduit or guide for a rope 303. The reel housing 301 includes a rope retrieving mechanism 309 that allows the rope 303 to extend when under tension and retrieves rope 303 when not under tension. One non-limiting example of a rope retrieving mechanism 309 includes a spring driven or motor driven reel around which the tow-rope 303 is wrapped, and wherein the reel rotates on a spindle. The tow rope 303 may also include a stopcatch and be in the form of specific dimensions as described above. When the tow-rope 303 is under tension, the pivotable arm 302 pivots from a first state shown in FIG. 9 to a second state shown in FIG. 10 toward the direction of tension. In a situation where the harness 300 is engaged on a side of a boat (not shown), and the tow-rope 303 is not under tension, the pivotable arm 302 pivots out to the side such that the rope 303 is urged alongside of the boat allowing for easy access to a downed wake surfer. As shown, the harness 300 includes a clamp 304 that is attached to a structure 305 (e.g. a tow-rack). The harness 300 may include a pivoting mechanism 307 interacting between the reel housing 301 and the pivotable arm 302 for urging the pivotable arm 302 to the first state when the rope 303 is not under tension and allowing the pivoting of the pivotable arm 302 toward a direction of tension when the rope 303 is under tension. By way of example, the pivoting mechanism 307 may be a spring mechanism, hydraulic mechanism or motorized mechanism.

Figure 12:
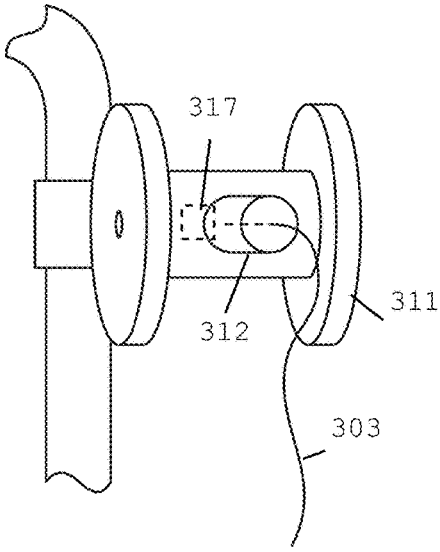
FIG. 12 shows the pivotable and retrievable rope system embodiment shown in FIG. 9 under tension.
Figure 11:
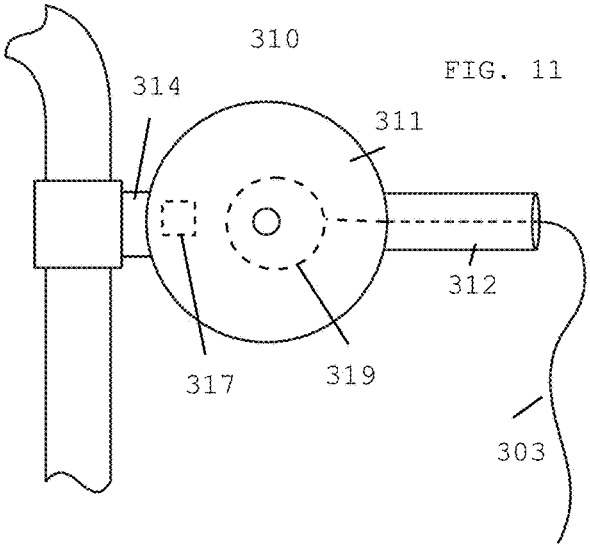
FIG. 11 shows a pivotable and retrievable rope system embodiment not under tension.

As shown in FIGS. 11-12, an alternative pivotable rope harness 310 is shown. The harness 310 also includes a reel housing 311 and arm 312 that serves as a conduit or guide for a rope 303. The reel housing 311 includes a rope retrieving mechanism 319 that allows the tow-rope 303 to extend when under tension and retrieves tow-rope 303 when not under tension. One non-limiting example of a rope retrieving mechanism 319 includes a spring driven or motor driven reel around which the tow-rope 303 is wrapped, wherein the reel rotates on a spindle. The tow-rope 303 may also include a stopcatch and be in the form of specific dimensions as described above. The harness 310 also includes a clamp 314 that is attachable to a structure 305 (e.g. tow rack). The spindle 311 pivots relative to the clamp 314 from a first state shown in FIG. 11 where the rope is not under tension to a second state shown in FIG. 12 when the rope 303 is under tension. The system 310 may include a pivoting mechanism 317 that interacts between the clamp 314 and the reel housing 311 for urging the reel housing 311 to the first state when the rope 303 is not under tension and allowing the pivoting of the reel housing 311 to the second state when the rope 303 is under tension. By way of example, the pivoting mechanism 317 may be a spring mechanism, hydraulic mechanism or motorized mechanism.

Figure 13:
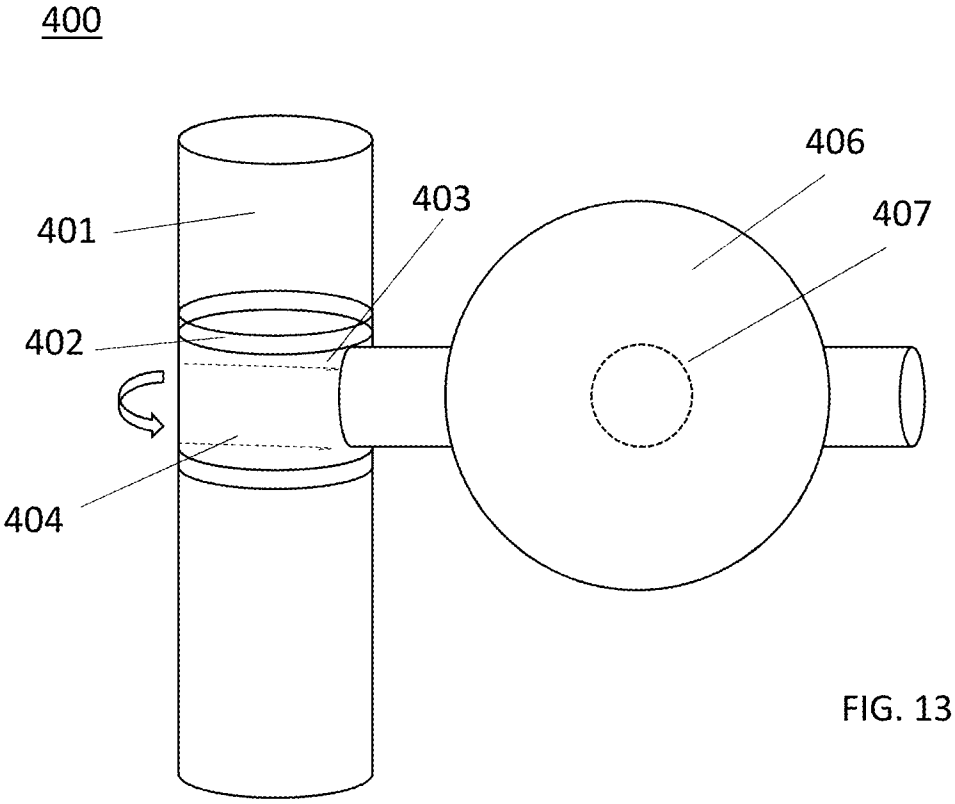
FIG. 13 shows a pivotable and retrievable rope system that allows for pivoting around a structure.

In an alternative embodiment, the clamp is associated with a structure such as a tow-rack whereby the clamp is able to pivot on the structure. This could take the form of a outer clamp that rotates relative to an inner clamp. For example, as shown in FIG. 13, a structure 401 is shown onto which an inner clamp 402 is attached. An outer clamp 403 is associated with the inner clamp 402 as to allow rotation or pivoting. The outer clamp 403 is associated with a spring mechanism 404 to urge the clamp to pivot back to an original state. Attached to the outer clamp 403 is a support structure 405 which includes a reel housing 406 with a rope retrieving mechanism 407.

Figure 15:
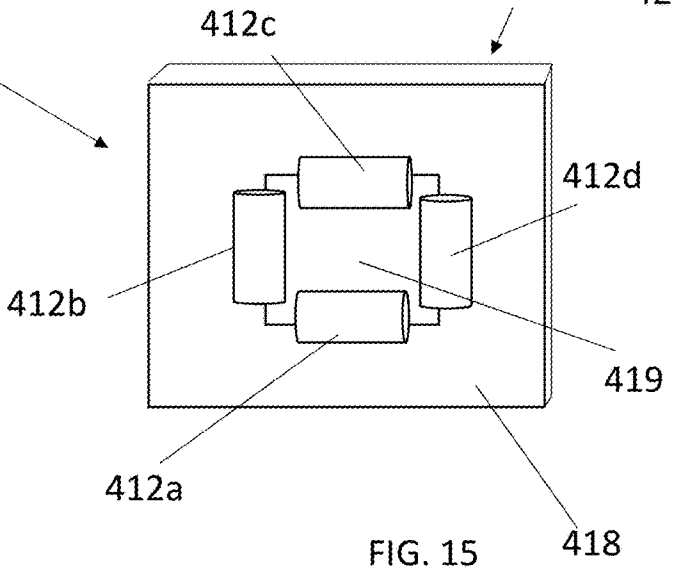
FIG. 15 shows a front view of the multidirection roller assembly shown in FIG. 14.
Figure 14:
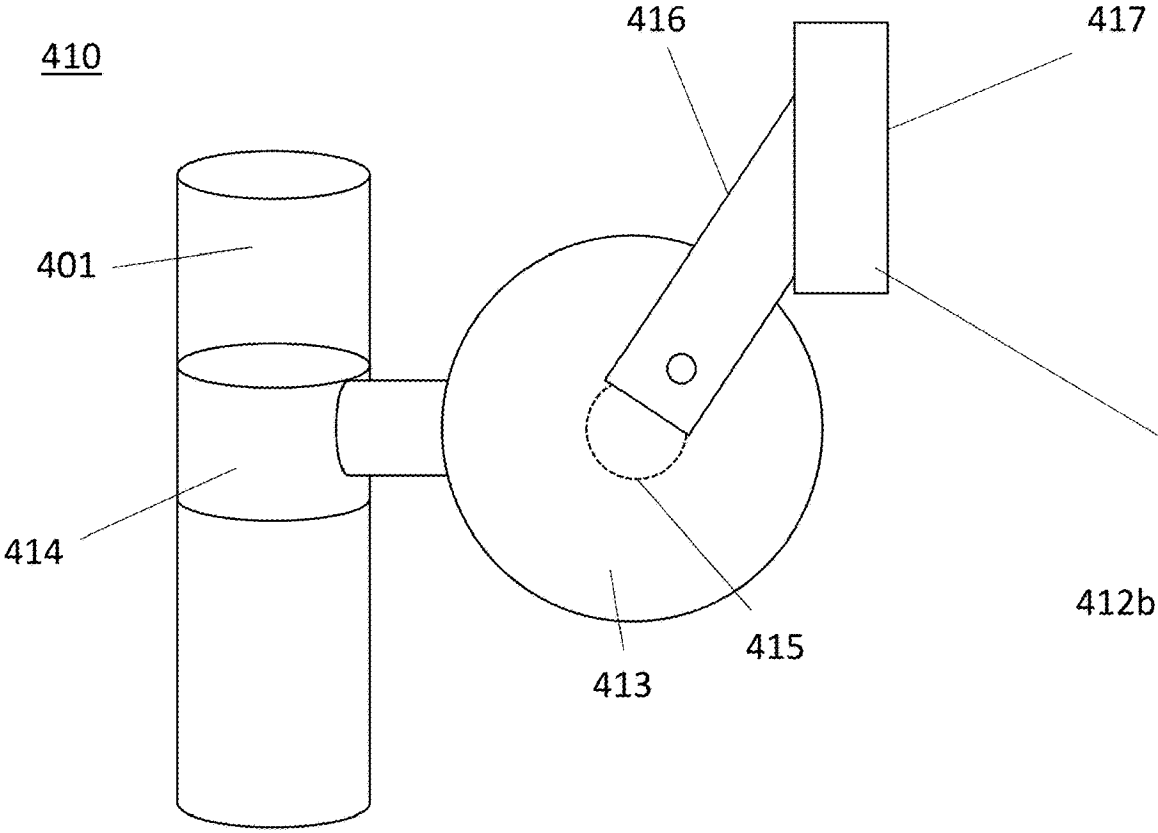
FIG. 14 shows a tow rope harness with a multidirection roller assembly.

According to another embodiment shown in FIGS. 14 and 15, a rope harness 410 is provided that is fixed to a structure 401 via clamp 414. The harness 410 includes a reel housing 413 to which a bracket 416 is attached. Associated with the reel housing is a rope retrieving mechanism 415. A multi-directional roller assembly 417 is associated with the bracket 416. FIG. 15 shows a front view of the assembly 417. The assembly includes an outer plate 418 with an aperture 419 through which a tow-rope can pass. Disposed at the edges of the aperture 419 are rollers 412*a-d*. The assembly 417 allows for a rope to be pulled toward a direction of tension while the rollers facilitate smooth passage of the rope. The rollers may be configured to rotate around a central axis. The rope harness 410 can be disposed on a structure 401 such that a tow-rope (not shown) is held toward the side of a boat (not shown) and allows for safe extension of the rope toward the direction of tension and retrieving of the rope and presentation of the rope to the side of the boat when not under tension. Any tow-rope embodiment described herein may be implemented in association with the rope harness 410 that includes suitable dimensions to facilitate safe operation of the rope, as described with respect to FIG. 4 for example. Also, the tow-rope may include a stop-catch member.

Figure 17:
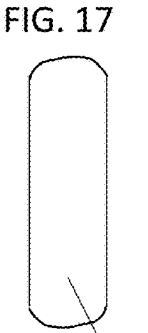
FIG. 17 shows a side view of the ring structure shown in FIG. 16.
Figure 16:
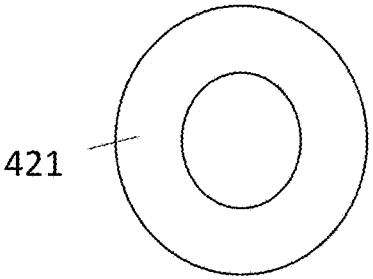
FIG. 16 shows a front view of a ring-structure that may substitute the multi-directional roller assembly in FIG. 14.

In an alternative embodiment shown in FIGS. 16 and 17, the multi-directional roller assembly is substituted by a ring 421, which is attached to bracket 416 shown in FIG. 14.

It should be borne in mind that all patents, patent applications, patent publications, technical publications, scientific publications, and other references referenced herein are hereby incorporated by reference in this application in order to more fully describe the state of the art to which the present invention pertains.

It is important to an understanding of the present invention to note that all technical and scientific terms used herein, unless defined herein, are intended to have the same meaning as commonly understood by one of ordinary skill in the art. The techniques employed herein are also those that are known to one of ordinary skill in the art, unless stated otherwise. For purposes of more clearly facilitating an understanding the invention as disclosed and claimed herein, the following definitions are provided.

What is claimed is:

1. A pivotable tow-rope harness for attaching to a structure of a boat comprising a reel housing;

a rope retrieving mechanism associated with the reel housing; wherein the rope retrieving mechanism comprises a retrieving reel engaged to the reel housing, the retrieving reel comprising a spool around which a tow-rope is wrapped;

an arm associated with the reel housing for guiding the tow-rope;

a pivoting mechanism associated with the reel housing such that the reel housing or the arm pivots toward a direction of tension on the tow-rope; and a clamp associated with the reel housing, wherein the pivoting mechanism interacts with the reel housing and/or clamp to allow the reel housing to pivot from a first state off to the side of the boat to a second state toward a direction of tension;

wherein the tow-rope comprises a stop-catch associated therewith that abuts the arm when the tow-rope is in a fully retracted state, and is fixed to the tow-rope at a location such that when the tow rope is fully retracted, a rope lag portion of at least 4 feet extends out of the arm to allow a sufficient amount of rope to remain in the water alongside the boat; and wherein the tow-rope extends from the arm 14-40 feet when in a fully extended state.

2. The pivotable tow-rope harness of claim 1, wherein the pivoting mechanism interacts with the reel housing and/or the arm to allow the arm to pivot from a first state to a second state toward a direction of tension.

3. The tow-rope harness of claim 1, wherein the clamp comprises an inner clamp for attaching to the structure, an outer clamp that pivots from a first state to a second state around the inner clamp and a spring mechanism associated with the inner clamp and outer clamp to urge the outer toward the first state.

4. The pivotable tow harness of claim 1, wherein the rope lag portion extends out of the arm 4-9 feet when the tow-rope is in a fully retracted state.

* * * * *